US012342965B2

(12) United States Patent
Mills et al.

(10) Patent No.: US 12,342,965 B2
(45) Date of Patent: Jul. 1, 2025

(54) BODY DRYER APPARATUS

(71) Applicant: JTK Designs, LLC., Roswell, GA (US)

(72) Inventors: Kelly H. Mills, Roswell, GA (US); Michael Tinstman, Malden, MA (US); Hannah Polster, Beverly, MA (US); Kyle Hounsell, Bellirica, MA (US); Marcus Hanna, Beverly, MA (US); Nate Streeter, Newton, MA (US); John Fiegener, Marblehead, MA (US)

(73) Assignee: JTK DESIGNS, LLC., Roswell, GA (US)

( * ) Notice: Subject to any disclaimer, the term of this patent is extended or adjusted under 35 U.S.C. 154(b) by 814 days.

(21) Appl. No.: 17/391,711

(22) Filed: Aug. 2, 2021

(65) Prior Publication Data

US 2022/0160190 A1 May 26, 2022

Related U.S. Application Data

(60) Provisional application No. 63/118,178, filed on Nov. 25, 2020.

(51) Int. Cl.
*A47K 10/48* (2006.01)

(52) U.S. Cl.
CPC ..... *A47K 10/48* (2013.01)

(58) Field of Classification Search
CPC ..... A47K 10/48
See application file for complete search history.

(56) References Cited

U.S. PATENT DOCUMENTS

| | | | | |
|---|---|---|---|---|
| 4,594,797 | A * | 6/1986 | Houck, Jr. | A01K 13/001 34/233 |
| 4,857,705 | A * | 8/1989 | Blevins | A47K 10/48 200/81.9 R |
| 5,103,577 | A | 4/1992 | Michaels et al. | |
| 6,842,581 | B2 | 1/2005 | Schafer | |
| 6,962,005 | B1 | 11/2005 | Khosropour et al. | |
| 10,582,815 | B1 | 3/2020 | Josey | |
| 10,827,886 | B2 | 11/2020 | Bullock | |
| 2005/0086735 | A1 | 4/2005 | Lim | |
| 2013/0341316 | A1* | 12/2013 | Perez | A47K 10/48 392/382 |
| 2016/0331193 | A1 | 11/2016 | Brown et al. | |

FOREIGN PATENT DOCUMENTS

| | | | |
|---|---|---|---|
| ES | 1238211 | U | 11/2019 |
| KR | 200328270 | Y1 | 9/2003 |
| KR | 200341303 | Y1 * | 2/2004 |

* cited by examiner

*Primary Examiner* — Jason Lau
(74) *Attorney, Agent, or Firm* — Perilla Knox & Hildebrandt LLP; Jason M. Perilla

(57) ABSTRACT

Disclosed are various embodiments of a modular dryer assembly for integration into a wall structure. In one embodiment, the modular dryer assembly comprises parallel structural members having first and second ends. An air blower is secured between the structural members for directing an air flow toward the second end of the structural member. A heating chamber receives the air flow from the blower compartment and exposes the air flow to a heating element. An air duct chamber extends from the heating chamber toward the second end of the structural member. A vent louver structure is attached to the air duct chamber. The vent louver structure is configured to direct the air flow from the air duct chamber to an exterior area.

11 Claims, 9 Drawing Sheets

BODY DRYER APPARATUS

CROSS REFERENCE TO RELATED APPLICATIONS

This application claims the benefit of and priority to U.S. Provisional Patent Application No. 63/118,178, filed Nov. 25, 2020, titled "Body Dryer," the entire contents of which is hereby incorporated herein by reference.

BACKGROUND

Typically, individuals use a towel to dry themselves after taking a bath or shower, swimming in a swimming pool, or finishing an exercise workout. Used towels are often placed in a locker, bag, or other laundry bin. Used towels may appear untidy if not properly stored. Additionally, it is typically necessary to launder used towels so they can be used again.

BRIEF DESCRIPTION OF THE DRAWINGS

Many aspects of the present disclosure can be better understood with reference to the following drawings. The components in the drawings are not necessarily to scale, with emphasis instead being placed upon clearly illustrating the principles of the disclosure. Moreover, in the drawings, like reference numerals designate corresponding parts throughout the several views.

DETAILED DESCRIPTION

Figure 1:
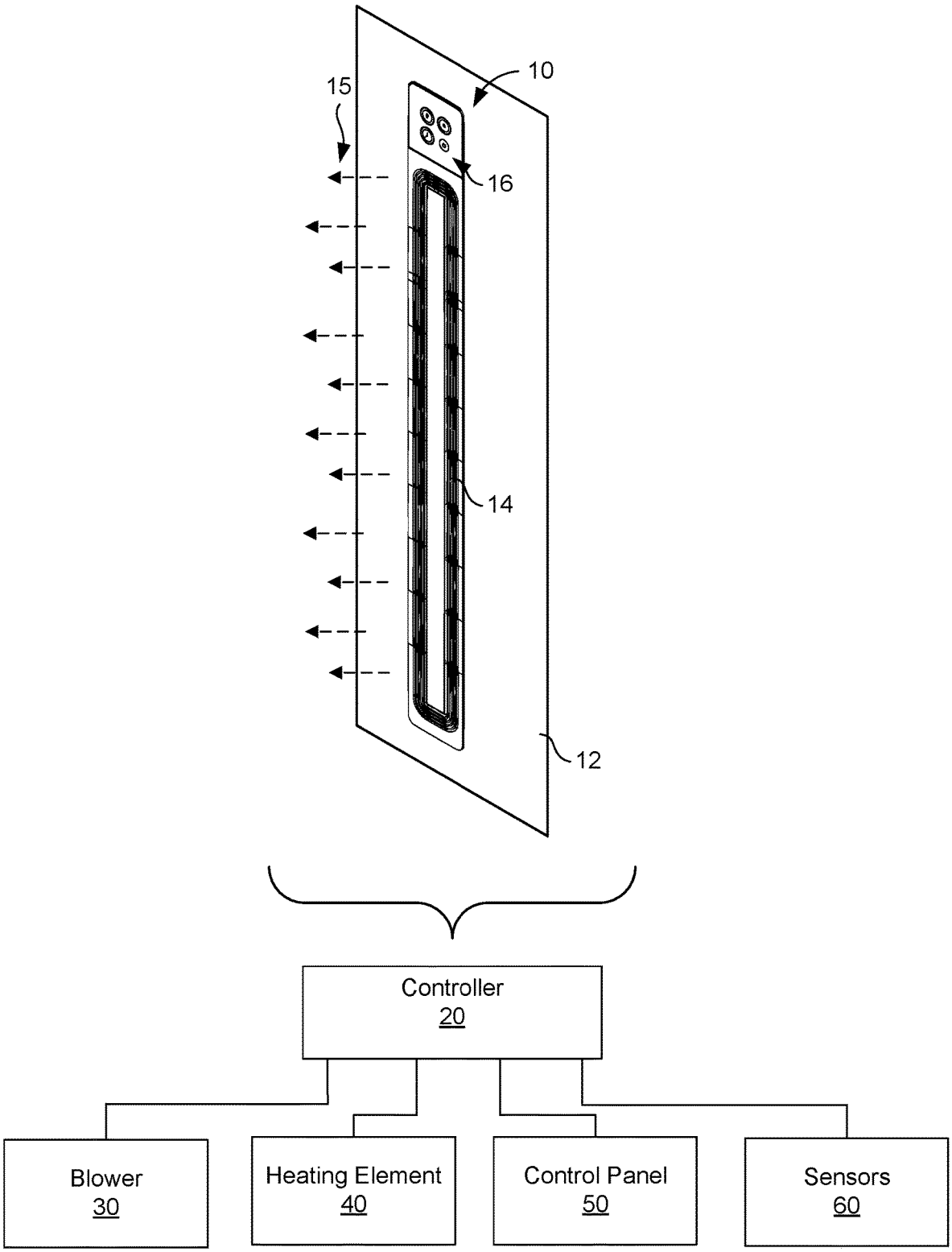
FIG. 1 illustrates a block diagram of various components of an example dryer apparatus according to various embodiments described herein.

The embodiments of the present disclosure relate to a body dryer apparatus that can be used to dry various portions of the human body. Oftentimes, individuals use a towel to dry themselves off in variety of different settings, such as after taking a shower, leaving a swimming pool, or finishing an exercise workout or a sports game. Afterwards, the used towel needs to be laundered for the next use. However, in many cases, used towels can be neglected and left in locker rooms, pool areas, gym bags, and other areas. As such, the neglected towels can make an area appear to be untidy and can be a source of odor in some cases.

The embodiments of the present disclosure are directed to a body dryer apparatus that offers many advantages, as compared to using a towel or in addition to using a towel.

The body dryer offers forced, heated air over a relatively large area, suitable to dry the body of an individual. The body dryer can be wall-mounted in locker rooms, swimming pool areas, shower enclosures, and other suitable areas where an individual may need to dry off. The body dryer is extended in length, vertically, and can be used to dry the entire body of an individual. The body dryer also offers a number of different settings to control the volume and rate of forced air, the temperature of the forced air, and the amount of time the body dryer runs before turning off.

The body dryer can be used along with (e.g., before, after, or during) towel drying, or as a substitute for towel drying. The body dryer can also be used for other purposes, such as warming shower enclosures, helping to dry shower enclosures that are wet, or even warming individuals and certain spaces in some cases.

The embodiments can be constructed in a number of different formats or form factors, including modular assembly formats. The modular assembly format of the body dryer simplifies the installation process. Relatively less time is required to install the modular assembly of the body dryer. In one example, the modular assembly can be manufactured and shipped to the installation site in a complete module, between and including 16-inch on-center wooden or metal studs. The modular assembly can be positioned into a section of unfinished wall and secured in place. An electrician can provide electrical connections to the body dryer before the drywall or other wall covering is installed over the modular assembly, and one or more vent louvers of the modular assembly can be installed over the drywall to finish installation of the body dryer.

In the context outlined above, various embodiments of a modular dryer assembly that integrates into a wall structure are described herein. In one embodiment, the modular dryer assembly includes parallel structural members having first and second ends. An air blower is secured between the parallel structural members, for directing an air flow toward the second end of the structural members. A heating chamber receives the air flow from the air blower and exposes the air flow to a heating element. An air duct chamber extends from the heating chamber toward the second end of the structural member. A vent louver structure is attached to the air duct chamber. The vent louver structure is configured to direct the air flow from the air duct chamber to an exterior area.

Turning to the drawings, FIG. 1 illustrates a block diagram of various components of an example dryer apparatus 10. FIG. 1 is provided as a representative example of the concepts and embodiments described herein, an example installation of the embodiments, and an example of certain components of the embodiments. FIG. 1 is not an exhaustive illustration of all components of the body dryers described herein, as many components are obscured from view. Also, one or more of the components illustrated in FIG. 1 and described below can be omitted in some cases. Additionally, particular examples of the dryer apparatus 10 are also described below with reference to FIGS. 2A-2C and the remaining drawings.

As shown, the dryer apparatus 10 is installed behind a wall 12, which can be formed using drywall, wallboard, cement board, or other suitable sheet material used to form walls, with or without tile, glass, or other covering materials installed over the sheet material. The dryer apparatus 10 can be installed in a number of different locations, including in a shower enclosure, in a larger bathroom, in a locker room, in a garage, or in any other area where drying, and particularly body drying, would be helpful to individuals.

Among other components, the dryer apparatus 10 includes a vent louvre 14 installed over the wall 12 and a number of control buttons 16 to control the operation of the dryer apparatus 10. The remaining components of the dryer apparatus 10 are installed and hidden behind (and within) the wall 12. A block diagram representative of the remaining components of the dryer apparatus 10 is provided at the bottom of FIG. 1. As shown, the dryer apparatus 10 includes a controller 20, which is electrically coupled to a blower 30, a heating element 40, a control panel 50, and sensors 60, among other components. Examples of other components of the dryer apparatus 10 include relays or contacts for controlling the flow of power to the blower 30 and the heating element 40, fuses, venting or ducting, thermal, vibration, and sound dampeners, air intakes and intake covers, air filters, fasteners, structural members, and other components.

The dryer apparatus 10 can be designed to any suitable size and dimensions. As compared to other dryers, such as hand dryers and hair dryers, the dryer apparatus 10 is generally designed to provide forced air 15 over a relatively larger area, such as over the extent or substantial extent of the body of an individual. In that context, the vent louvre 14 can be between about 2-18 inches in width (i.e., from right to left on the page) and between 2-6 feet in height (i.e., from top to bottom on the page), such as 3 feet, 2.5 feet, 3 feet, 3.5 feet, 4 feet, 4.5 feet, 5 feet, 5.5 feet, or 6 feet in height. Thus, when an individual is standing in proximity to the vent louvre 14, the forced air 15 is ejected from the dryer apparatus 10 along the length of the vent louvre 14, to blow against a substantial extent of the body of the individual.

The controller 20 can include an embedded controller, processor, or processing circuit, including memory. The controller 20 can control and direct the overall operation of the dryer apparatus 10, including the operations of the blower 30 and the heating elements 40, based on feedback or control signals from the control panels 50, the sensors 60, and other elements. The controller 20 can be directed by firmware, the execution of computer-readable instructions (i.e., software), or other suitable logic (e.g., including state machine or embedded logic), and be configured through the logic to direct the operation of the dryer apparatus 10 as described herein. In some cases, the dryer apparatus 10 can include a network interface controller, such as a wired or wireless (e.g., WI-FI®, BLUETOOTH®, etc.) interface for data communications. The network interface controller can also be coupled to the controller 20 to control operations of the dryer apparatus 10, to communicate data on the operations or operating status of the dryer apparatus 10, or for other purposes.

The blower 30 can be embodied as one or more blower motors and fan blades or assemblies suitable for driving the forced air 15 though the venting and ducting of the dryer apparatus 10 and, ultimately, through the vent louvre 14. The volume and velocity of the forced air 15 can be directed by the controller 20, based on user input provided at the control panel 50 using the buttons 16. The blower 30 can include one or more single-speed or variable-speed motors, of any suitable type for the application and purpose. The blower 30 can be arranged along with the heating element 40, with intermediary venting and ducting, to direct forced air generated by the blower 30 over the heating element 40 and through the vent louvre 14 as described herein.

The heating element 40 can be embodied as one or more heating elements that convert electrical energy into heat through the process of Joule heating. Electric current, which can be turned on and off through a relay, for example, can flow through the heating element 40, which converts the electric energy into heat. The heating element 40 can include one or more wires, ribbons, fins, or other elements to distribute the current and generation of heat, and can be formed from metal (e.g., nicrhome, kanthal, cupronickel, etc.), ceramic, semiconductor, polymer, or other materials.

The control panel 50 can include the buttons 16, among other interface elements that permit a user of the dryer apparatus 10 to control its operation. The control panel 50 can be designed for both wet and dry operating environments. As examples, the buttons 16 can be capacitive or thin, push-button style buttons under a single, continuous surface of the control panel 50, for easy cleaning and maintenance. The control panel 50 can include buttons to separately control power (i.e., on/off operation), heat (i.e., temperature of the forced air 15), volume of the forced air 15, and time, although other controls are within the scope of the embodiments. The control panel 50 can also include one or more indicator lights, such as light emitting diodes (LEDs) or other lights, to present visual indicators of the current operating state and status of the dryer apparatus 10.

The sensors 60 can include temperature sensors, current sensors, proximity sensors, and other sensors to direct the operation of the dryer apparatus 10. Feedback signals from the sensors 60 can be electrically coupled to the controller 20. As examples, the sensors 60 can include a temperature sensor to provide a temperature feedback signal to the controller 20, to control the temperature of the forced air 15. The sensors can also include current or power draw sensors to provide a power feedback signal to the controller 20, which can be relied upon to monitor the operation of the heating element 40. The dryer apparatus 10 can also include a proximity sensor, in one example, as a type of interlock to control the operation of the dryer apparatus 10. In that case, the dryer apparatus 10 may be operable only if an individual is standing within a certain proximity to the dryer apparatus 10. Other sensors 60 can be incorporated into the control panel to detect fingers manipulating buttons.

Figure 2A:
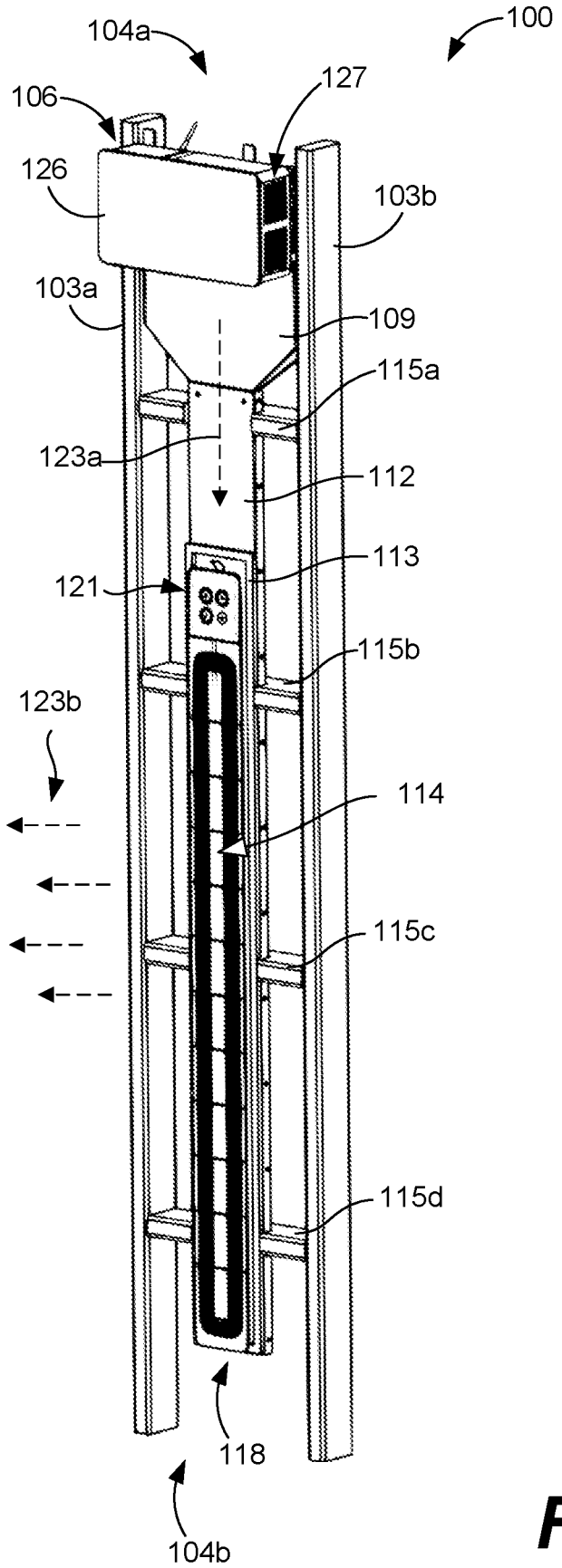
FIG. 2A is a perspective view of a dryer apparatus for drying an individual according to an example embodiment described herein.
Figure 2B:
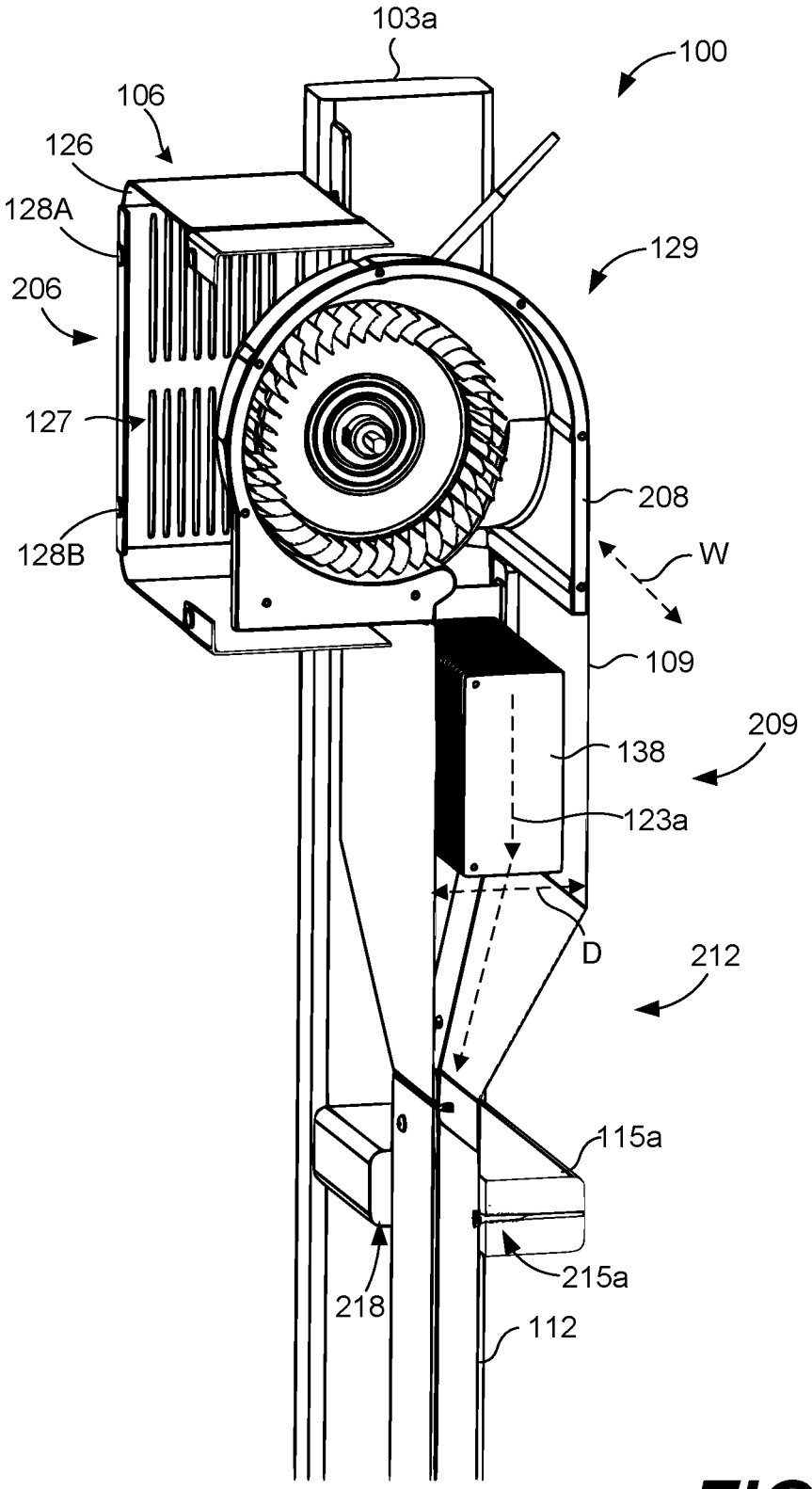
FIGS. 2B and 2C illustrate various cross-sectional views of the dryer apparatus shown in FIG. 2A according to an example embodiment described herein.
Figure 2C:
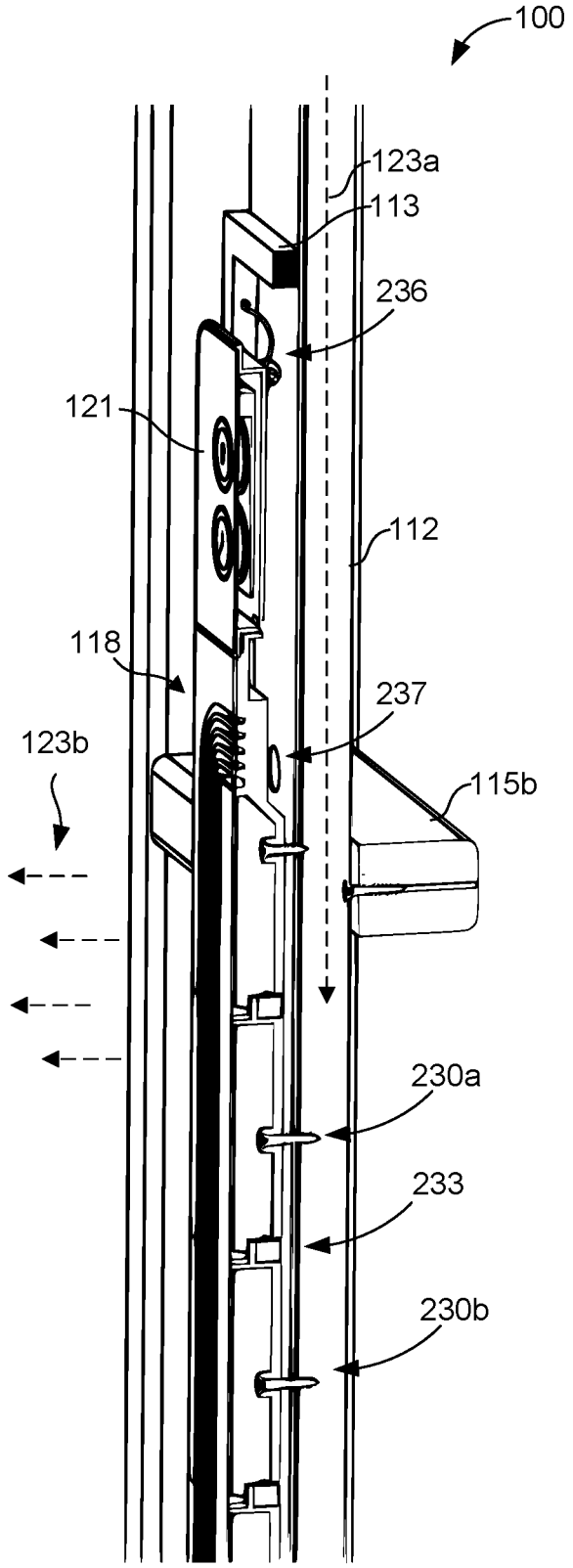

Turning to more particular examples, FIG. 2A is a perspective view of a dryer apparatus 100 for drying an individual according to an example embodiment described herein. FIGS. 2B and 2C illustrate cross-sectional views of the dryer apparatus 100 shown in FIG. 2A. The dryer apparatus 100 is a more particular example of the dryer apparatus 10 shown in FIG. 1. In FIGS. 2A-2C, the wall material (e.g., drywall, cement board, etc.) is omitted from view. The wall material can be used to conceal various components of the dryer apparatus 100 and provide a consistent visual appearance with the surround wall areas.

The dryer apparatus 100 can be constructed as a modular apparatus or assembly and delivered as a single unit to a job site. During installation, the dryer apparatus 100 can be attached to a wall frame, such as between the header and the footer of the framing for a new wall. As examples, the dryer apparatus 100 can be installed in various indoor and outdoor residential and commercial settings, such as in shower enclosures, locker rooms, gym areas, swimming pool areas, spa areas, and other suitable areas.

Referring among FIGS. 2A-2C, the dryer apparatus 100 includes a first structural member 103*a*, a second structural member 103*b*, a blower compartment 106, a heating chamber 109, an air duct chamber 112, a spacer ring 113, spacing structures 115*a-d*, a vent louver structure 118, a control panel 121, and other components. In the modular assembly format shown in FIGS. 2A-2C, the first structural member 103*a*, the second structural member 103*b* (collectively referred to as "the structural members 103"), and the spacing structures 115*a-d* are used as framing and support members for other components of the dryer apparatus 101. Thus, the other components of the dryer apparatus 100, including the blower compartment 106, heating chamber 109, air duct chamber 112, etc., are mechanically fastened and supported by the framing and support members.

The structural members 103 have a first end 104*a* and a second end 104*b*. The structural members 103 can be arranged and positioned in parallel to each other, as shown. The structural members 103 may be spaced apart in a range between 8 inches and 32 inches apart. As one example, the structural members 103 can be about 16 inches apart, similar to typical spacing for wall studs. In some embodiments, the structural members 103 can be embodied as two by four dimensional wood or metal framing. However, the size and relative positioning of the structural members 103 can vary. Further, although the structural members 103 are substantially straight in the illustrated embodiments, the shape of the structural members 103 can also vary. Additionally, the number of structural members 103 used in the dryer apparatus 100 can vary. When installed in a home or other setting, the structural members 103 can be attached to a wall frame of a building structure. For example, the structural members 103 can be secured in place between a top or header frame member, a bottom or footer frame member, and other structural components of a building (see FIG. 6). In other examples, however, the structural members 103 and the spacing structures 115*a-d* can be omitted, and the dryer apparatus 100 can be manufactured and shipped to customers without them.

The blower compartment 106 can be embodied as an area for housing certain components of the dryer apparatus 100, including the components for air intake, generating forced air flow 123*a*, and heating the forced air flow 123*a*. In that context, the blower compartment 106 provides an area for mechanical and electrical components of the dryer apparatus 100, such as a blower motor 129, a controller compartment 132 (see FIG. 5), and other components. In the example shown, the blower compartment 106 resides between the structural members 103 and exists largely behind or within the wall when the dryer apparatus 100 is installed.

The dryer apparatus 100 also includes an access panel 126 for installation over the blower compartment 106. The access panel 126 encloses the blower compartment 106 to some extent, particularly to the outside of the wall in which the dryer apparatus 100 is installed. The access panel 126 can be formed from metal, plastic, or other suitable materials and forms an enclosure with air intake vents 127. The access panel 126 can be a removable component of the dryer apparatus 100 that provides access to the mechanical components in the blower compartment 106. In one example, the access panel 126 can include magnetic latches 128A and 128B (see FIG. 2B), among others, for securing a front panel of the access panel 126 over the blower compartment 106. The magnetic latches 128A and 128B can be secured or otherwise embedded in flanges that extend inward from a periphery of the access panel 126, as shown in FIG. 2B. The front panel of the access panel 126 can be formed from metal and adhere to the magnetic latches 128A and 128B. When the front panel of the access panel 126 is removed, an operator has access to the mechanical and electrical components in the blower compartment 106 and the heating chamber 109, for easy servicing of the dryer apparatus 100.

As shown, the blower compartment 106 is positioned in between the structural members 103 and at the first end 104*a* of the structural members 103. The first end 104*a* of the structural members 103 is raised relative to the ground or floor when the dryer apparatus 100 is installed. Thus, the blower compartment 106 is positioned to avoid water from reaching the air intake vents 127 at the sides of the access panel 126. As such, the blower compartment 106 will typically be positioned at a relatively high position along the wall, such as near the ceiling. The height of the structural members 103 can be adjusted in order to fit the dimension of the wall frame.

Figure 5:
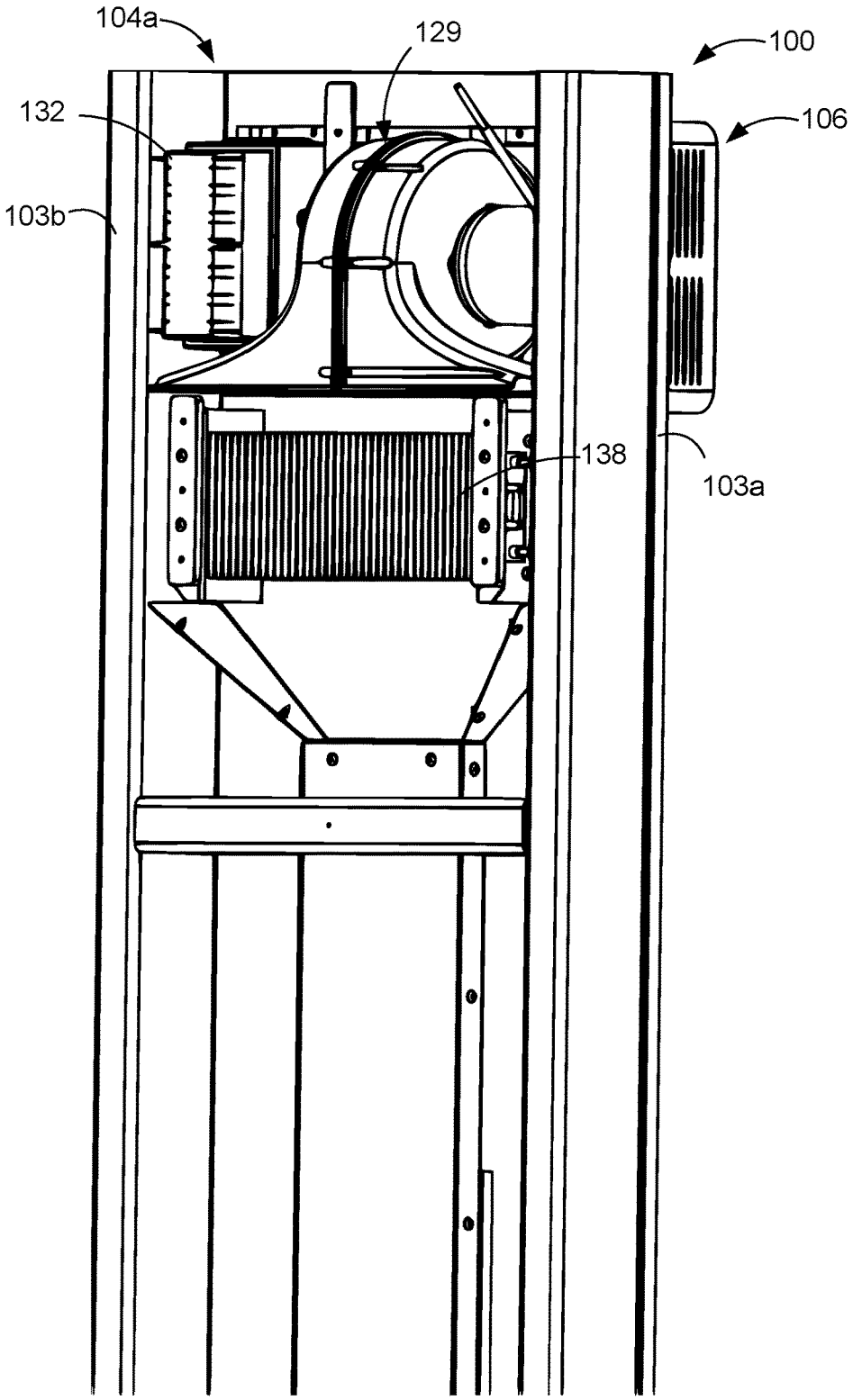
FIG. 5 illustrates a rear view of a top portion of the dryer apparatus shown in FIG. 2A, according to an example embodiment described herein.

The blower 129 shown in FIG. 2B and FIG. 5 is one example of the blower 30 shown in FIG. 1. A cross-sectional view of the blower 129 is shown in FIG. 2B, with the motor of the blower 129 omitted from view. The blower 129 can include a blower motor (not shown in FIG. 2B) and the fan blades shown in FIG. 2B, among other components for generating the forced air flow 123*a* though the venting and ducting of the dryer apparatus 100. The blower 129 can include a single-speed or variable-speed motor, of any suitable type for the application and purpose. As shown, the blower 129 is arranged along with intermediary venting and ducting, to direct the forced air flow 123*a* from the blower 129 over the heating element 138. In other examples, the blower 129 can be embodied as any suitable type of blower with a motor and fan blades to create the forced air flow 123*a*.

The controller compartment 132 can include an enclosure for housing certain electrical, mechanical, and electro-mechanical components of the dryer apparatus 100, including the controller 20, a power converter for the controller 20, and the power relays or power semiconductor switches, fuses, and other components. Among other components, the controller 20 can be secured within the controller compartment 132 (see FIG. 5). As noted above, the controller 20 can be electrically coupled to other components of the dryer apparatus 100, including the blower motor 129 and the heating element 138, through power relays or power semiconductor switches in some cases. The controller compartment 132 can be a junction box, as shown in FIG. 5, among other suitable enclosures. In other examples, the controller compartment 132 can be larger or smaller than that shown in FIG. 5, and the controller compartment 132 can be positioned at other locations between the structural members 103.

The dryer apparatus 100 can be electrically connected to power, such as 110V or 220V electric power service at any suitable wattage, and the power converter for the controller 20 can convert this power source to a low voltage (e.g., 12V, 10V, 5V, etc.) power source for the controller 20. The 110V or 220V service can also be regulated (i.e., connected or switched on, disconnected or switched off, or ramped) by power relays or power semiconductor switches electrically coupled between the power service and the blower motor 129 and the heating element 138. The controller 20 can direct the power relays or power semiconductor switches to control the flow of power to the blower motor 129 and the heating element 138 based on user control provided at the control panel 121 and other logic implemented by the controller 20.

The heating chamber 109 of the dryer apparatus 100 can be embodied as a compartment for securing and housing the heating element 138 and for receiving the air flow 123*a* from the blower motor 129, exposing the air flow 123*a* to the heating element 138 (see FIG. 2B), and providing the heated air flow 123*a* to the air duct chamber 112. As shown in FIG. 2B, the heating chamber 109 can have a tapered shape to funnel the air flow 123*a* into the air duct chamber 112. The heating chamber 109 can be constructed of sheet metal in one example, although other suitable materials can be relied upon.

The air duct chamber 112 provides a fluid passageway for the air flow 123*a* to travel from the heating chamber 109 to the vent louver structure 118. Although the air duct chamber 112 is shown as having a rectangular shape in FIG. 2A, the shape can vary. The air duct chamber 112 has a region which includes openings (FIGS. 2B and 4) that enable the air flow 123*a* to travel to the vent louver structure 118.

The spacer ring 113 can be embodied as a ring of compressible foam or other material that provides a buffer between the air duct chamber 112 and the vent louver structure 118. The spacer ring 113 can provide a buffer for the reduction of noise, the exclusion of water, maintaining the separation of heat, and for other purposes. The spacer ring 113 can be formed in any suitable dimensions and be positioned at any suitable location on the front surface of the air duct chamber 112. In one example, the spacer ring 113 is larger in peripheral dimensions than the vent louver structure 118.

The spacing structures 115*a-d* (collectively "the spacing structures 115") are support structures that are attached and secured between one or more of the structural members 103. The spacing structures 115 can be oriented laterally, at an angle, and in other suitable orientations. FIG. 2A illustrates that multiple spacing structures 115 are oriented laterally and are attached between the first structural member 103*a* and the second structural member 103*b*. The spacing structures 115 support the air duct chamber 112. For example, FIG. 2A illustrates that the spacing structures 115 have a cut-out or recessed region in which the air duct chamber 112 can be positioned for structural support.

The vent louver structure 118 can be one or more vent structures for the air flow 123*b* to travel from the air duct chamber 112 to an exterior area beyond the dyer apparatus 100. The vent louver structure 118 can be secured and attached to the air duct chamber 112, as described in further detail below. The vent louver structure 118 has mechanical structures (e.g., fins or blades) for directing the air flow 123*b*. The mechanical structures of the vent louver structure 118 can direct the air flow 123*a* from openings of the air duct chamber 112 through the vent louver structure 118. As such, the air flow 123*a* first travels downward though the air duct chamber 112. Then, the air flow 123*a* can travel laterally through the openings (e.g., see air duct openings 237 in FIG. 2C and FIG. 4) in the air duct chamber 112 and through the vent louver structure 118. The air flow 123*b* passing through the vent louver structure 118 can be directed onto a nearby individual for drying. As examples, the vent louver structure 118 can be constructed from stainless steel, galvanized steel, plastic, or combinations thereof, and other suitable materials can be used.

The vent louver structure 118 can be embodied as a single structure or multiple segments. The segments of the vent louver structure 118 can be connected to each other and also attached to the air duct chamber 112, as described in further detail below. The vent louver structure 118 can include a number of baffle slots or fins. The vent louver structure 118 also includes a cover plate 114 as shown in FIG. 2A. The cover plate 114 can conceal fasteners and other structural components of the vent louver structure 118, which are described below with reference to FIGS. 3A-3C. In some embodiments, the cover plate 114 can be formed from metal and magnetically latch or adhere to the vent louver structure 118. The cover plate 114 can be constructed from various types of metals or types of plastic.

The control panel 121 can include one or more buttons to control the operations of the dryer apparatus 100. The control panel 121 can include a button for adjusting the temperature of the air flow 123*b*, a button for adjusting the speed of the air flow 123, a button for powering on/off the dryer apparatus 100, a button for setting a timer for the dryer apparatus 100, and other suitable buttons. In some embodiments, the buttons include touch push-button style buttons under a single, continuous surface in order to enable wet fingers to activate the controls. In some embodiments, the control panel 121 can include a display and other visual indicators to indicate the state of various operations related to the dryer apparatus 100.

The heating element 138 can be secured to the interior walls of an upper region 209 of the heating chamber 109. The heating element 138 can be secured in place within the heating chamber 109 using intermediary heat insulators or dampers, vibration dampers, or other offsets to centrally position and separate the heating element 138 from the heating chamber 109. The upper region of the heating chamber 109 has a rectangular shape, and a lower region 212 of the heating chamber 19 has a tapered shape. The width "W" and the depth "D" of the lower region 212 decrease in order to compress the air flow 123*a*, as it is provided to the air duct chamber 112. As such, the upper area of the lower region 212 has a larger width "W" and depth "D" than the bottom area of the lower region 212. Additionally, the shapes of the various regions of the heating chamber 109 can vary.

FIG. 2A also illustrates an upper region of the air duct chamber 112. The upper region of the air duct chamber 112 can funnel the air flow 123*a* from the heating chamber 109 down to a lower region of the air duct chamber 112 (FIG. 2B). The air duct chamber 112 can be attached to the spacing structure 115*a* with a fastener 215*a*. The air duct chamber 112 can be positioned in a recessed region 218 of the spacing structure 115*a*. The depth of the recessed region 218 can be greater than the depth of the air duct chamber 112, in one example.

With the access panel 126 removed, an operator can access the various components that may require service through an access panel opening 206. For example, the blower motor 129 is accessible through the access panel 126. When the blower motor 129 is removed, the heating element 138 can also be accessed. Accordingly, when the dryer apparatus 100 is installed in a finished wall structure, a service operator does not have to tear into the wall in order to service the components of the dryer apparatus 100.

FIG. 2B illustrates a cross-sectional view of the middle region of the air duct chamber 112, the control panel 121, portions of the vent louvre structure 118, and other suitable components. The air duct chamber 112 is attached to the vent louvre structure 118 by one or more fasteners 230*a*, 230*b* (collectively "the fasteners 230"). The fasteners 230 can be used to adjust the surface of the vent louvre structure correspond to a thickness of a substrate material for the surrounding wall. For example, the thickness of drywall can differ from the thickness of cement board, and the wall can also vary in thickness depending upon the type of tile or other covering used. The fastener 230 can be inserted through the vent louvre structure 118 to such a degree in order for the surface of the vent louvre structure 118 to set and rest upon the wall. For example, the fastener 230 can be screwed into the vent louvre structure 118 until the surface corresponds to the surrounding wall. Each segment of the vent louvre structure 118 can have one or more fasteners 230 for attaching the segment to the air duct chamber 112. Further, two adjacent segments of the vent louvre structure 118 can form a segment connection 233. The structural components forming the segment connection 233 will be described in FIG. 4.

As shown in FIG. 2C, the top segment of the vent louvre structure 118 is secured, in part, behind the control panel 121. The attachment comprises the top segment of the vent louvre structure 118 and the control panel 121 having extension structures that interlock. Two buttons are displayed on the control panel 121 and two additional buttons are omitted from view in FIG. 2C. The control panel 121 is also secured by a spring 236, which fits behind the drywall, cement board, or other wall substrate.

Additionally, the air duct chamber 112 has multiple air duct openings 237. Although only one is visible in FIG. 2B, several other air duct openings are spaced throughout the lower region of the air duct chamber 112. The air duct opening 237 is a passageway for the air flow 123*a* to travel from the air duct chamber 112 through the vent louvre structure 118, as indicated by the arrows for the air flow 123*b*. In some embodiments, the air duct opening 237 can have a perimeter that is curved and extends toward the vent louvre structure 118. The curved perimeter can reduce the resistance of the air flow 123*b* and prevent air noise (e.g., whistling).

Figure 3A:
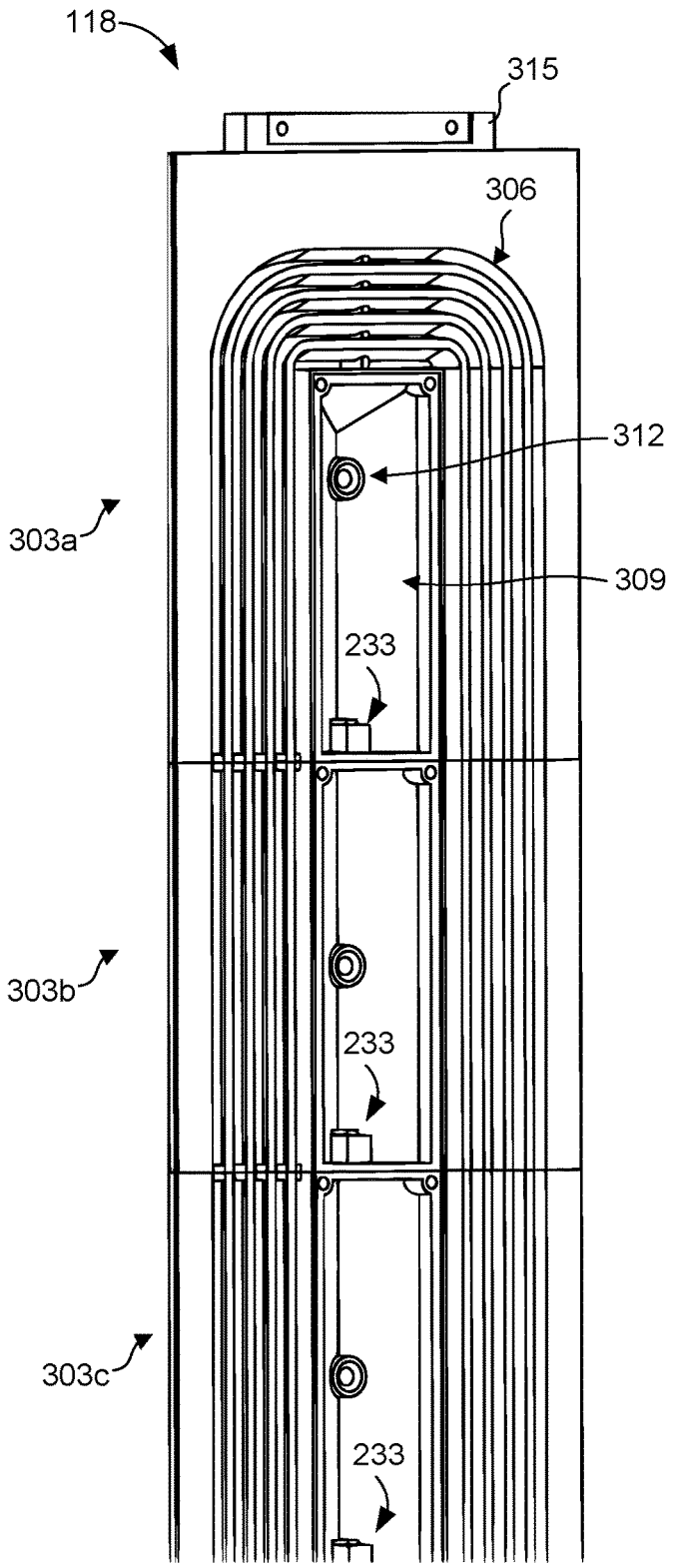
FIGS. 3A-3C illustrates perspective views of various portions of the vent louver structure shown in FIG. 2A, according to an example embodiment described herein.
Figure 3B:
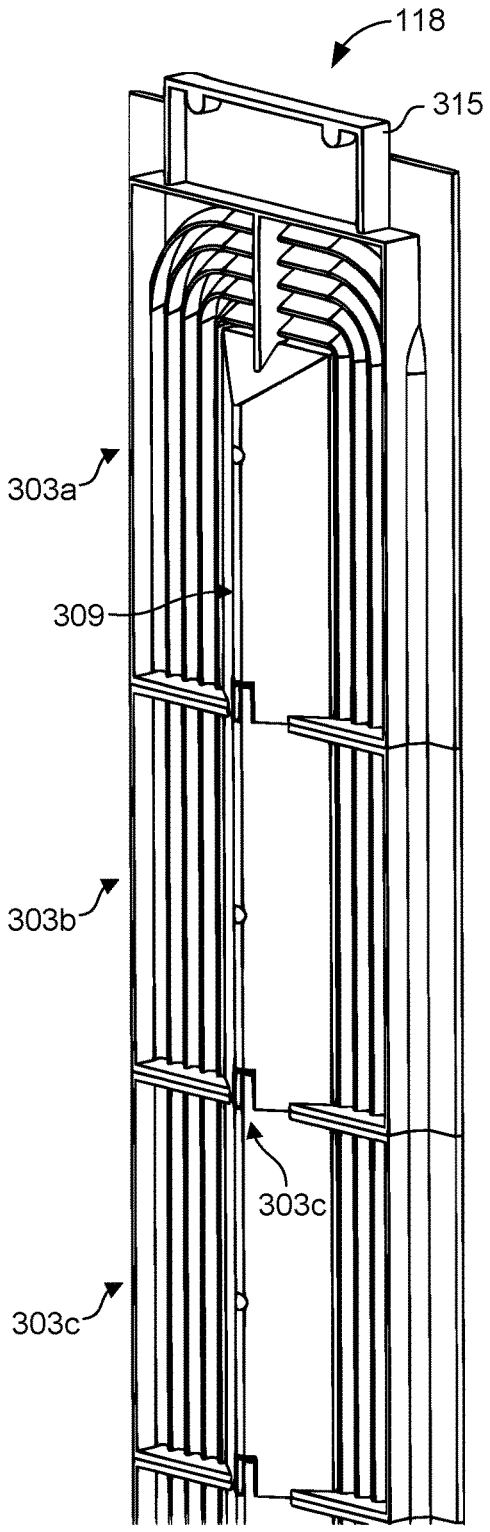

With reference to FIGS. 3A and 3B, shown are different views of a portion of the vent louvre structure 118. The vent louver structure 118 shown in FIGS. 2A, 2C, and 3A-3C is one example of the vent louvre 14 shown in FIG. 1, and other shapes, sizes, types, and styles of vent louvres can be relied upon. FIG. 3A illustrates a front perspective view of the vent louvre structure 118, and FIG. 2B illustrates a back perspective view of the vent louvre structure 118. The vent louvre structure 118 can be comprised of one or more segments 303*a-c* (collectively "the segments 303"). The segments 303 include one or more baffles 306 that are positioned at an angle. The baffles 306 are used to direct the air flow 123*b*.

As shown in FIGS. 3A and 3B, the segments 303 interlock together to form the vent louvre structure 118. Each segment 303 can also include a wedge 309 that recedes away from the baffles 306 and toward the air duct chamber 112 when attached to the dryer apparatus 100. FIG. 3B illustrates a rear view of the wedge 309. As such, the wedge 309 forms a recessed area from a front view of the wedge 309. The wedge 309 can be constructed to direct the air flow 123*b* toward the baffles 306. Within the wedge 309, each segment 303 can include a wedge opening 312. The wedge opening 312 can be used to receive fastener 230. An operator can adjust the segment 303 to match the thickness of a wall substrate by a degree in which the fastener 230 is inserted (e.g., by screwing the fastener 230) into the wedge opening 312.

FIGS. 3A and 3B illustrate that the segments 303 can vary in their configuration. For example, segment 303*a* has a different baffle arrangement than segments 303*b*, 303*c*. Segment 303*a* is constructed to be situated in a top portion or a bottom position of an arrangement for the vent louvre structure 118. Segment 303 also includes an extension tab 315. The extension tab 315 can interlock with a portion of the control panel 121. The extension tab 315 has a lateral recessed area. Additionally, FIGS. 3A and 3B illustrate the segment connections 233 between two adjacent segments 303.

Figure 3C:
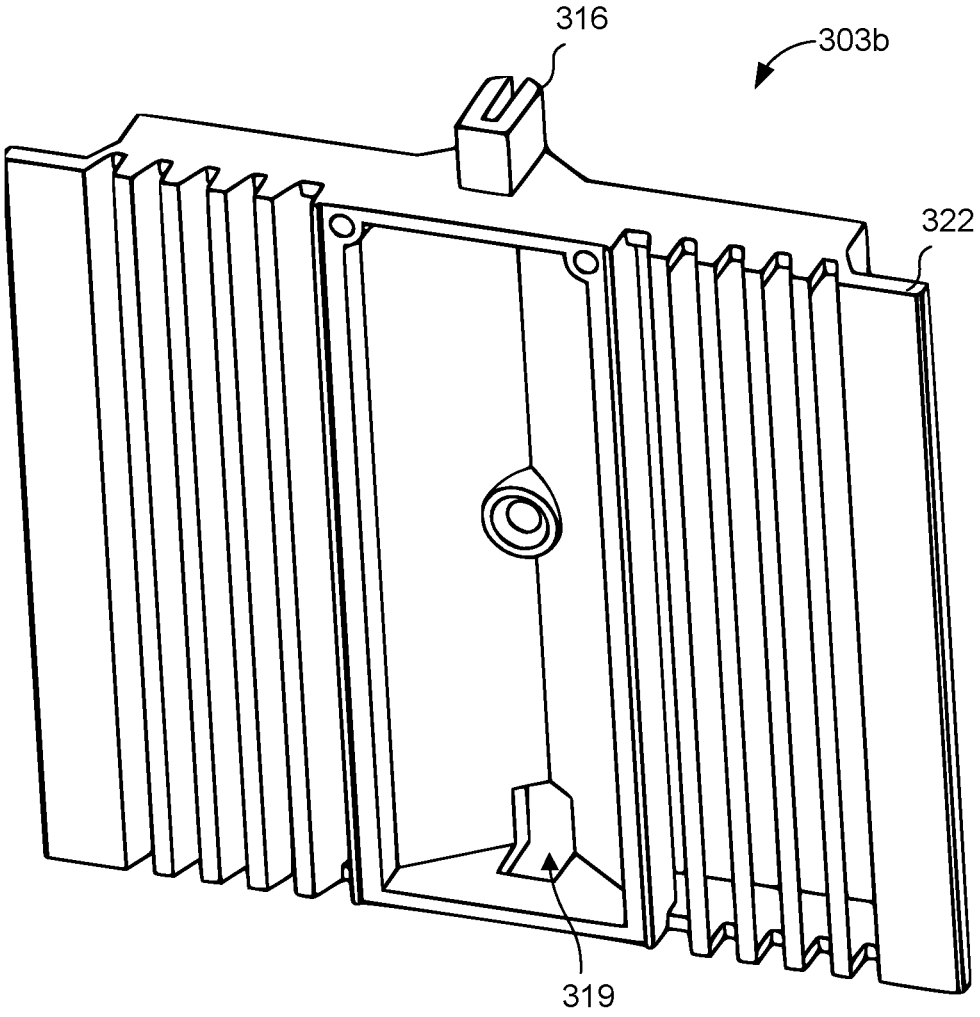

FIG. 3C illustrates a perspective view of the segment 303*b* of the vent louvre structure 118. FIG. 3 illustrates that the segment 303*b* has a protrusion 316 on a top portion of the segment 303*b*. The segment 303*b* has a segment opening 319 on a bottom portion of the segment. The protrusion 316 and the segment opening 319 are used to interlock as shown in FIG. 3B to form the segment connection 233. Additionally, the segment 303*b* has a flange 322 along its perimeter.

Figure 4:
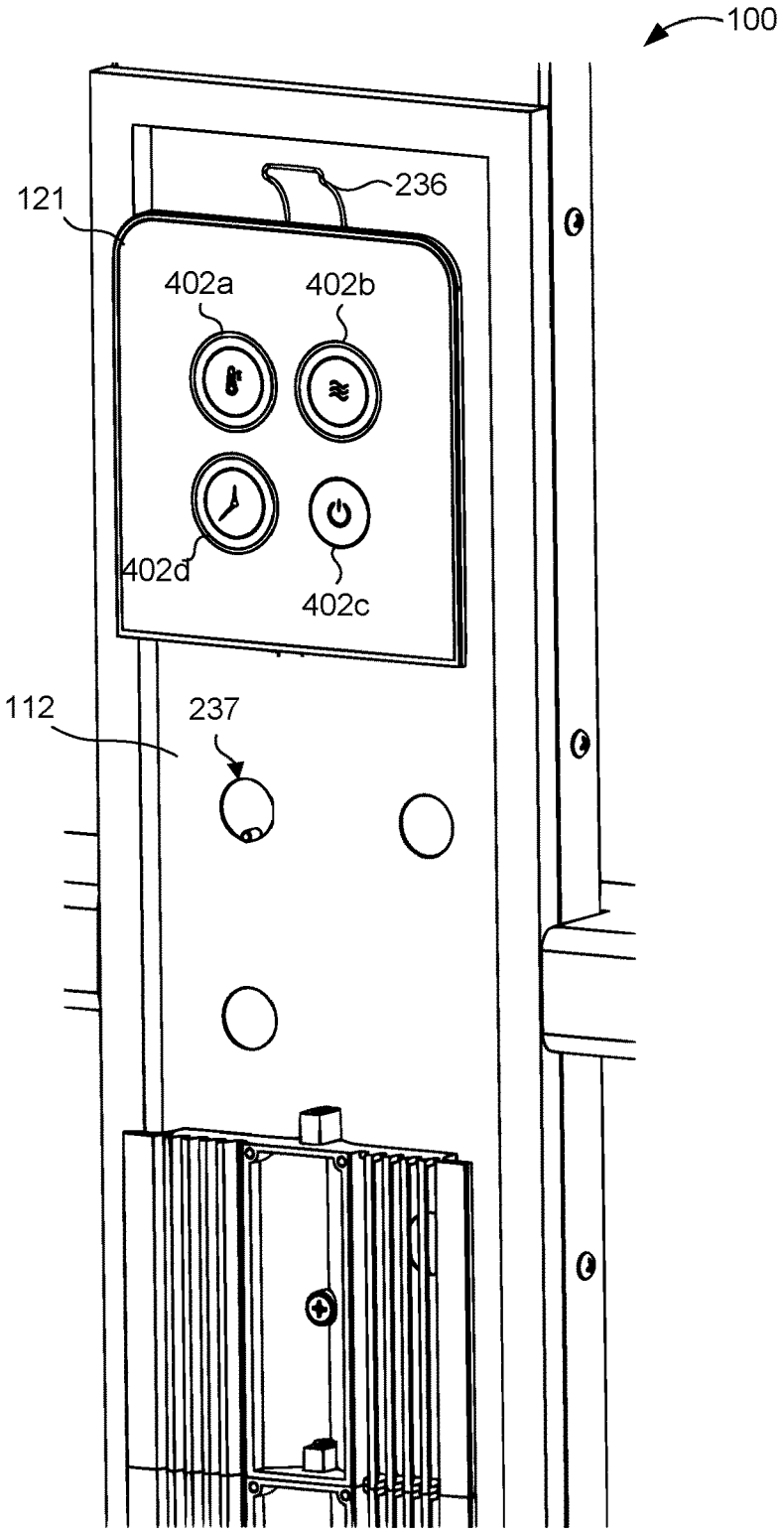
FIG. 4 illustrates a portion of the dryer apparatus shown in FIG. 2A, according to an example embodiment described herein

FIG. 4 illustrates a middle portion of the dryer apparatus 100. In FIG. 4, portions of the dryer apparatus 100 are omitted in order to view other aspects of the dryer apparatus 100. FIG. 4 illustrates a number of the air duct openings 237 in the air duct chamber 112. The air duct chamber 112 includes additional air duct openings behind the vent louver structure 118, which are obscured from view. The air duct openings 237 are evenly spaced through the lower region of the air duct chamber 112. The spacing, the size, and the arrangement of the air duct openings 237 can vary in order to generate different types of air flows 123*b* exiting the vent louvre structure 118. For example, in some embodiments, a greater number of air duct openings 237 may be positioned closer to bottom of the vent louvre structure 118. In other another embodiments, the air duct openings 237 can have a smaller diameter near the control panel 121 and the diameter of the air duct openings 237 can increase for ones closer to the bottom of the vent louvre structure 118.

The control panel 121 includes four buttons 402*a-d* as shown in FIG. 4. Control signals from the control panel 121 are electrically coupled back to the controller 20, to direct operation of the controller 20. Although the control panel 121 is illustrated as having four buttons 402*a-d* (collectively "the buttons 402"), the number and functions of the buttons 402 can vary. In FIG. 4, the control panel 121 has a temperature button 402*a* for adjusting the temperature of the air flow 123*b*, a speed button 402*b* for adjusting the speed of the air flow 123, a power button 402*c* for powering on/off the dryer apparatus 100, a timer button 402*d* for setting a timer for the dryer apparatus 100, and other suitable buttons. In one example, the buttons 402 can be thin, push-button style buttons under a single, continuous surface of the control panel 121. In another example, the buttons 402 can comprise sensors for identifying a touch of a finger even with water on the control panel 121. The sensors can include touch capacitance sensors, proximity sensors, and other suitable sensors for identifying manipulation of the buttons 402.

Additionally, buttons 402*a*, 402*b*, and 402*d* have a circle of light emitting diodes (LED) surrounding a respective button. One or more of the LEDs can activate or deactivate to provide a visual indicator of the present setting for the buttons 402*a*, 402*b*, and 402*d*. For example, four LEDs may surround the temperature button 402*a*. If one LED is activated, it may light up a quarter of a circle around the button 402. It may represent a first or lowest temperature setting for the dryer apparatus 100. After the user selects the temperature button 402*a* again, a second LED may be activated and the dryer apparatus 100 can cause the heating element 138 to increase in temperature. The second LED and the first LED may cause a half of the circle to be lit. The two LEDs can represent a second temperature setting for the dryer apparatus 101.

The button 402*a* can incrementally increase or decrease the temperature of the air flow 123*b*. The button 402*a* can control or facilitate the regulation of the heating element 138. By way of the heating element 138, the dryer apparatus 100 can regulate a temperature of the air flow 123*b* in a suitable range for body drying. The button 402*b* can incrementally increase or decrease the speed of the air flow 123. The speed can be adjusted by controlling the blower motor 129. The button 402*d* can be used to set an amount of time for the dryer apparatus 100 to be powered on or for the blower motor 129 to generate the air flow 123*b*. After the set time has expired, the blower motor 129 can stop the air flow 123 or the dryer apparatus 100 can power off.

FIG. 5 illustrates a rear view of a top portion of the dryer apparatus 100. The back panel of the heating chamber 109 is omitted from view. FIG. 5 illustrates how the controller compartment 132 is positioned at the first end 104*a* of the structural members 103, and the controller compartment 132 is positioned adjacent to the blower motor 129.

Next, a general description of some example operations of the various components of the dryer apparatus 100 is provided. An individual that is wet can approach the dryer apparatus 100. The individual can access the control panel 121 and touch the power button 402*c* for powering the dryer apparatus 100. The activation of the power button 402*c* can send a control signal to the controller 20 to power on the dryer apparatus 100. In some embodiments, touching the power button 402*c* causes the blower motor 129 to power on and initiate an air flow 123*a* before the heating element 138 is activated. Touching the power button 402*c* again causes the heating element 138 to turn off for a period of time before the blower motor 129 is turned off. In other embodiments, after selecting the power button 402*c*, a user may have to select the speed button 402*b* to start an air flow 123*a*.

After the air flow 123 has started, an individual can adjust a temperature of the air flow 123 by further selecting the temperature button 402*a*. One or more of temperature LEDs may activate or deactivate to reflect a present temperature setting for the dryer apparatus 100. In some embodiments, the temperature button 402*a* can provide certain levels or steps of heat increase, such as 10° F. steps. In other cases, the temperature button 402*a* can be relied upon to increment in smaller steps, such as 5, 2, or 1° F. steps. Additionally, the individual can adjust the speed of the air flow 123 by selecting the speed button 102*b*. One or more of the speed LEDs may activate or deactivate to reflect a present speed setting for the dryer apparatus 100. The individual can also select the timer button 402*d* in order to set a period of time for the dryer apparatus 100 to continuously produce the air flow 123. After the time period has expired, the dryer apparatus 100 can cause the blower motor 129 halt the air flow 123. In some embodiments, the expiration of the time period causes the dryer apparatus 100 to power off.

Figure 6:
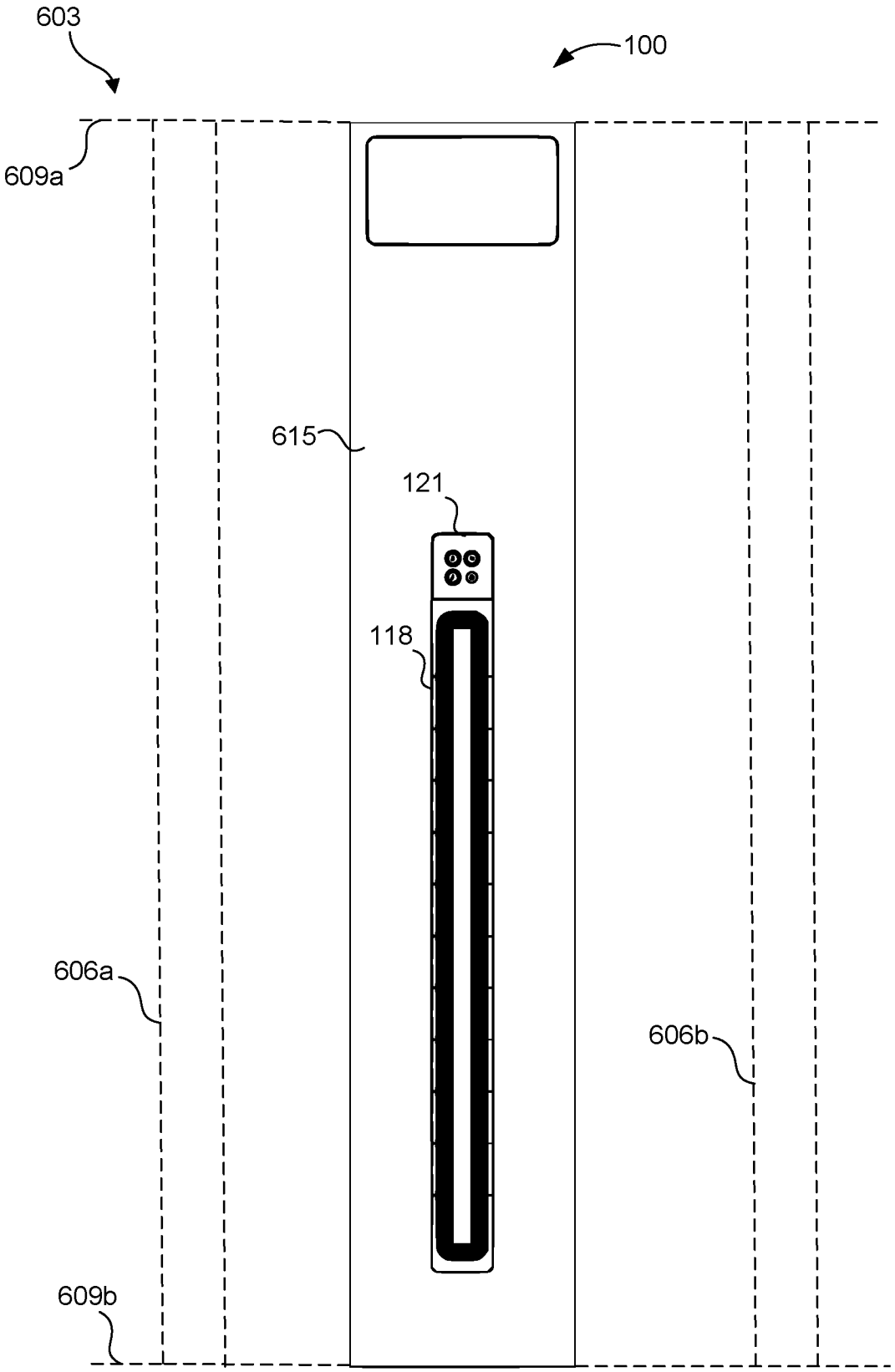
FIG. 6 illustrates a front view of the dryer apparatus integrated in a wall frame of a building structure, according to an embodiment described herein.

FIG. 6 illustrates a diagram of the dryer apparatus 100 integrated into a wall structure 603. The wall structure 603 can represent a commercial building or a residential building. The wall structure 603 can include a frame of various wall studs 606*a*, 606*b* and platform studs 609*a*, 609*b*. The dryer apparatus 100 can be attached to a top platform stud 609*a* and a bottom platform stud 609*b*. The dryer apparatus 100 can be inserted int the wall structure 603 instead of one or two studs. In FIG. 6, the dryer apparatus 100 include a drywall panel 615 that surrounds the control panel 121 and the vent louver structure 118. The drywall panel 615 conceals the other components of the dryer apparatus 100. The drywall panel 615 can be finished to correspond to the wall areas on both sides of the dryer apparatus 100. Accordingly, the dryer apparatus 100 can be integrated into the wall structure 603 and the dryer apparatus 100 have a finished appearance (e.g. paint applied over the drywall panel 615) to blends with the rest of the wall.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A modular dryer apparatus, comprising:

a first structural member and a second structural member positioned in parallel, the first structural member and the second structural member having a first end and a second end;

an air blower for generating and directing an air flow toward the second end of the first structural member and the second structural member;

a heating chamber attached between the first structural member and the second structural member, the heating chamber comprising a heating element, the heating chamber positioned to receive the air flow from the air blower and to expose the air flow to the heating element;

an air duct chamber that extends from the heating chamber further toward the second end of the first structural member and the second structural member, the air duct chamber receiving the air flow from the heating chamber and having a plurality of openings;

a vent louver structure for attachment to the air duct chamber, the vent louver structure directing the air flow from the plurality of openings of the air duct chamber to an exterior area beyond the air duct chamber; and a foam ring positioned between the air duct chamber and the vent louver structure.

2. The modular dryer apparatus of claim 1, wherein the first structural member and the second structural member comprise framing structures for positioning between a header and a footer of a wall.

3. The modular dryer apparatus of claim 1, further comprising:

a lateral spacing structure attached between the first structural member and the second structural member, the lateral spacing structure supporting the air duct chamber.

4. The modular dryer apparatus of claim 1, wherein the vent louver structure comprises a plurality of interlocking vent louver segments, and each vent louver segment comprising a bottom opening at a bottom end and a protrusion at a top end.

5. The modular dryer apparatus of claim 4, wherein each vent louver segment is centrally secured to the air duct chamber using a fastener.

6. The modular dryer apparatus of claim 5, further comprising:

a magnetic cover panel for attachment to the vent louver structure, the magnetic cover panel concealing the fastener of each vent louver segment.

7. The modular dryer apparatus of claim 1, wherein the vent louver structure comprises a wedge for directing the air flow.

8. The modular dryer apparatus of claim 1, further comprising a control panel, the control panel comprising at least one of a temperature control button, a power control button, an air flow control button, or a timer control button.

9. The modular dryer apparatus of claim 8, wherein the control panel comprises at least one mechanical interlock with the vent louver structure.

10. The modular dryer apparatus of claim 8, wherein the control panel comprises at least one spring to mechanically secure the control panel.

11. The modular dryer apparatus of claim 1, wherein the plurality of openings are curved and extend toward the vent louvre structure.

* * * * *